US008363870B2

(12) United States Patent
Åsnes

(10) Patent No.: US 8,363,870 B2
(45) Date of Patent: Jan. 29, 2013

(54) VIBRATOR

(75) Inventor: Kristian Åsnes, Mölndal (SE)

(73) Assignee: Cochlear Bone Anchored Solutions AB, Molnlycke (SE)

( * ) Notice: Subject to any disclaimer, the term of this patent is extended or adjusted under 35 U.S.C. 154(b) by 1502 days.

(21) Appl. No.: 11/884,753

(22) PCT Filed: Feb. 9, 2006

(86) PCT No.: PCT/SE2006/000179

§ 371 (c)(1),
(2), (4) Date: Aug. 21, 2007

(87) PCT Pub. No.: WO2006/088410

PCT Pub. Date: Aug. 24, 2006

(65) Prior Publication Data

US 2008/0319250 A1 Dec. 25, 2008

(30) Foreign Application Priority Data

Feb. 21, 2005 (SE) ..... 0500388

(51) Int. Cl.
*H04R 25/00* (2006.01)

(52) U.S. Cl. ..... 381/326; 600/25

(58) Field of Classification Search ..... 381/326; 600/25

See application file for complete search history.

(56) References Cited

U.S. PATENT DOCUMENTS

| | | | |
|---|---|---|---|
| 4,380,689 | A | 4/1983 | Giannetti |
| 4,498,461 | A | 2/1985 | Hakansson |
| 4,904,233 | A | 2/1990 | Håkansson et al. |
| 5,673,328 | A | 9/1997 | Wandl et al. |
| 5,771,298 | A | 6/1998 | Davis et al. |
| 6,068,589 | A | 5/2000 | Neukermans |
| 6,483,917 | B1 | 11/2002 | Kang et al. |
| 6,751,334 | B2 | 6/2004 | Håkansson |

FOREIGN PATENT DOCUMENTS

| | | | |
|---|---|---|---|
| SE | 447948 | B | 12/1986 |
| WO | WO-01/93633 | A1 | 12/2001 |
| WO | WO-01/93634 | A1 | 12/2001 |
| WO | WO-01/93635 | A1 | 12/2001 |
| WO | WO-03/096744 | A1 | 11/2003 |

OTHER PUBLICATIONS

PCT/ISA/210—International Search Report—Jun. 14, 2006.

PCT/ISA/237—Written Opinon of the International Searching Authority—Jun. 14, 2006.

Peder U. Carlsson; On Driect Bone Conduction Hearing Devices; Technical Report No. 195; Göteborg, Sweden; Mar. 1990.

Anders Tjellström et al; The Bone-Anchored Hearing Aid; Design Principles, Indications, and Long-Term Clincal Results; Otolaryngologic Clinics of North America, vol. 28, No. 1; Feb. 1995.

*Primary Examiner* — David S. Warren

(74) *Attorney, Agent, or Firm* — Kilpatrick, Townsend & Stockton, LLP.

(57) ABSTRACT

An electromagnetic vibrator for generating vibrations in bone conducting hearing aid devices. The vibrator includes a magnetic device, a vibrator plate and an inner spring member providing an air-gap between the magnetic device and the vibrator plate. The vibrator is housed in a casing and an outer spring is arranged between the vibrator and the casing to isolate movements of the magnetic device relative to the casing. The outer spring is part of the surrounding casing and is mechanically attached to the vibratory transmitting element via an elastic sealing element. The sealing function of the hearing aid housing is provided by the outer spring attachment.

12 Claims, 2 Drawing Sheets

VIBRATOR

CROSS-REFERENCE TO RELATED APPLICATIONS

This application claims priority to Swedish patent application 0500388-4 filed 21 Feb. 2005 and is the national phase under 35 U.S.C. §371 of PCT/SE2006/000179 filed 9 Feb. 2006.

FIELD OF THE INVENTION

The present invention relates to a vibrator for generating vibrations in a bone conducting hearing aid, i e a hearing aid of the type in which the sound information is mechanically transmitted via the skull bone directly to the inner ear of a person.

BACKGROUND OF THE INVENTION

For persons with impaired hearing, the hearing aid devices which are most commonly used today are those based on the principle that the sound is amplified and fed into the auditory meatus and stimulates the eardrum from the outside. In order to prevent acoustic feedback problems in these devices, the auditory meatus is almost completely plugged by a hearing plug or by the hearing aid device itself. This causes the user a feeling of pressure, discomfort, and sometimes even eczema. In some cases it even causes the user problems like running ears due to chronic ear inflammations or infections in the auditory canal.

However, there are other types of hearing aids on the market, i e hearing aids based on another type of sound transmitting principle, specifically bone conducting hearing aids which mechanically transmit the sound information to a persons inner ear via the skull bone by means of a vibrator. The hearing aid device is connected to an implanted titanium screw installed in the bone behind the external ear and the sound is transmitted via the skull bone to the cochlea (inner ear), i e the hearing aid works irrespective of a disease in the middle ear or not. The bone anchoring principle means that the skin is penetrated which makes the vibratory transmission very efficient.

This type of hearing aid device has been a revolution for the rehabilitation of patients with certain types of impaired hearing and it has also been found that it can be a help for persons with stuttering problems. It is very convenient for the patient and almost invisible with normal hair styles. It can easily be connected to the implanted titanium fixture by means of a bayonet coupling or a snap in coupling. One example of this type of hearing aid device is described in U.S. Pat. No. 4,498,461 and it is also referred to the BAHA® bone anchored hearing aid marketed by Entific Medical Systems in Göteborg.

Other types of bone conducting hearing aids are described in U.S. Pat. No. 4,904,233 and WO 01/93635.

A common feature for the hearing aid devices which have been described so far is that some type of vibratory generating means, vibrators, are required. Different types of vibrators are well known in the art. There are a number of known vibrator principles today. In traditional as well as in bone anchored hearing aid devices it is normally used a vibrator principle which was described already by Bell in 1876. There is a detailed description of this principle applied on a bone anchored, bone conducting hearing aid device in "On Direct Bone Conduction Hearing Devices", Technical Report No. 195, Department of Applied Electronics, Chalmers University of Technology, 1990. Other vibrators of this type are described in WO 01/93633, WO 01/93634, U.S. Pat. No. 6,751,334 and PCT/SE03/00751.

A typical vibrator of this type comprises a magnetic device, a vibrator plate and a so-called inner spring member in order to provide an air-gap between the magnetic device and the vibrator plate. In order to reduce the risk for acoustic feed back problems in the hearing aid device it is necessary to damp the resonance frequency of the vibrator. In this context it is referred to Swedish Patent No. 85.02426-3 in which it is described a vibrator which comprises a vibrator plate and a coil which is wound around a bobbin base with a core and two side walls. It also comprises means for damping the resonance frequency of the vibrator such that the spring member is provided with a layer of a damping material or a built-in damping material. The entire vibrator arrangement is housed in a casing and a so-called outer spring in the form of a thin metal plate is arranged between the vibrator arrangement and the casing in order to isolate the movements of the magnetic device relative to the casing. The outer spring is suspended into the vibrator casing via elastic elements, silicon pads or the like.

The vibrator plate is mechanically connected via a vibratory transmitting element to a coupling device, such as a snap-in coupling, a bayonet coupling, a magnetic coupling or the like, for connecting the outer hearing aid part to the bone anchored part of the hearing aid device.

To prevent dust and dirt to come into the hearing aid housing there is a sealing between the casing of the hearing aid and the vibratory transmitting element, for instance an O-ring.

A disadvantage with this type of vibrator arrangement is the fact that it comprises so many small parts which makes it difficult to assemble. The separate suspension of the outer spring and the sealing of the casing comprises small elastic elements which must be robust enough to withstand a long-time use of the hearing aid but also weak and soft enough to serve as a vibratory isolating and dust sealing element.

Another disadvantage with the known arrangement is the fact that the vibratory isolation is not always optimal due to the fact that the outer spring in the form of a small, thin metal plate which is used today is weak in one direction, perpendicular to the plane of the spring plate, but stiff against movements in other directions parallel to the plane of the spring plate and also stiff against rotary movements. Vibratory movements in these directions are absorbed by the silicon pads only.

SUMMARY OF THE INVENTION

It is therefore an object of the present invention to provide a vibrator arrangement which comprises a less number of small, mechanically sensitive parts but which still has a good vibratory isolating and dust sealing effect.

Another object of the invention is to improve the vibratory isolation for movements in directions which are parallel to the plane of the spring and for rotary movements.

According to the invention the outer spring is a part of the surrounding casing and is mechanically attached to the vibratory transmitting element via an elastic sealing element. The sealing function in the hearing aid housing is then provided by the spring attachment and there is no need for separate sealing means as in previous devices.

According to a preferred embodiment the outer spring is an integral part of the surrounding casing and having a spring characteristics which is adapted to vibratory isolation.

According to a further preferred embodiment the outer spring is made as a thin membrane, plate or the like made of a rubber or plastic material and arranged on that part of the wall casing of the hearing aid device which is opposite to the bone anchored part.

BRIEF DESCRIPTION OF THE DRAWINGS

In the following the invention will be described more in detail in connection with the accompanying drawings, in which.

DETAILED DESCRIPTION OF EMBODIMENTS OF THE INVENTION

Figure 1:
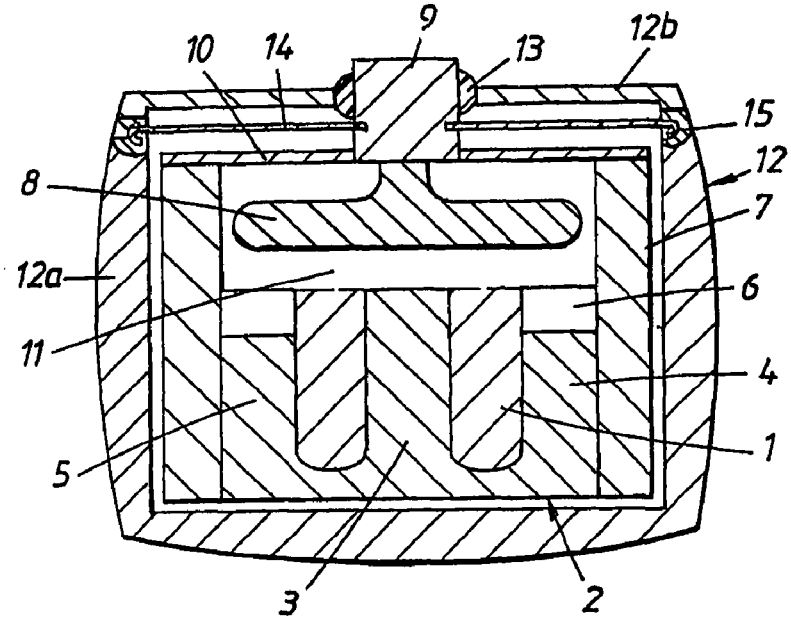
Fig. 1 (Prior Art)
FIG. 1 illustrates a cross-section through a previously known vibrator arrangement (prior art)

FIG. 1 shows a cross-section through the central axis of a vibrator of the variable-reluctance type. The vibrator comprises a coil 1 which in the known way is wound around a bobbin base 2 with a core 3 and two side walls 4, 5. On the two side walls there are two annular permanent magnets 6 arranged. The entire coil and magnet arrangement is housed in a casing 7 which forms a part of the magnetic circuit and protects the vibrator and reduces magnetic leakage. The bobbin base and the casing are made of a material with high magnetic conductivity. The vibrator further comprises a vibrator plate 8 which is mechanically attached to a vibratory transmitting element 9 which in the known way comprises a first coupling member (not shown) for connecting the outer hearing aid housing to the bone anchored part of the hearing aid device. The coupling device could be any type of known snap-in coupling, bayonet coupling, magnetic coupling or the like. However, the coupling device is not a part of the present invention and will not be described in any detail here. A so-called inner spring member 10 is attached between the vibrator plate 8 and the inner casing 7 in order to provide and maintain an air-gap between the vibrator plate and the magnetic device. In order to damp the resonance frequency of the vibrator the spring member might be provided with a layer of a damping material and/or the vibrator gap 11 between the vibrator plate 8 and the magnetic device might be filled with a fluid or gel. Through its viscosity and capillary properties the fluid has the ability to damp the resonance frequency of the vibrator and thereby reduce the risk for acoustic feed back problems in the hearing aid device.

The entire vibrator arrangement is housed in a casing, a hearing aid housing 12. The enclosing casing preferably comprises two parts, the housing itself 12*a* and a substantially planar lid member 12*b*. The lid member 12*b* is provided with an opening for the vibratory transmitting element 9 with a dust sealing element 13 to prevent dust and dirt to come into the hearing aid housing. The sealing element is made of any elastic material, such as rubber or the like.

A so-called outer spring 14 in the form of a thin metal plate is arranged between the vibratory transmitting element 9 and the casing 12 in order to isolate i e the movements of the magnetic device relative to the casing 12. By means of a suitable spring characteristic and attachment to the casing via silicon pads 15 or the like it is prevented that any vibratory movements are transferred to the casing.

In the known vibrator arrangement that has been described so far the dust sealing element 13 and the outer spring attachment by means of silicon pads or the like constitutes two separate components in the casing. As already mentioned it is a disadvantage to handle so many small mechanical components.

Figure 2:
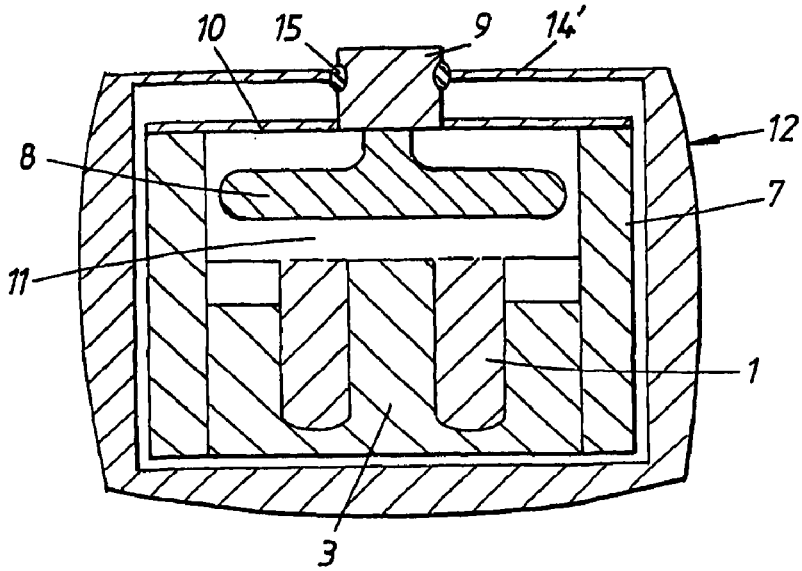
FIG. 2 illustrates a vibrator arrangement according to the invention.

In FIG. 2 it is illustrated a vibrator arrangement in which the outer spring 14' is integrated with the outer casing 12. The attachment of the spring has been combined with a dust- and dirt sealing element 15. Apart from that the vibrator arrangement has the same configuration as shown in FIG. 1. However, by integrating the outer spring 14' as a part of the casing wall, so that it corresponds to the lid member 12*b* in FIG. 1, then there is no need for any separate dust- or dirt sealing in the casing. The attachment of the outer spring member 14' centrally to the vibratory transmitting element 9 via an elastic element 15, silicon pad or the like, is also arranged in such a way that the bushing is tight against dust and dirt.

The new attachment of the outer spring might involve an adaption of the spring characteristic in order to maintain a satisfactory isolation of vibratory movements.

Figure 3:
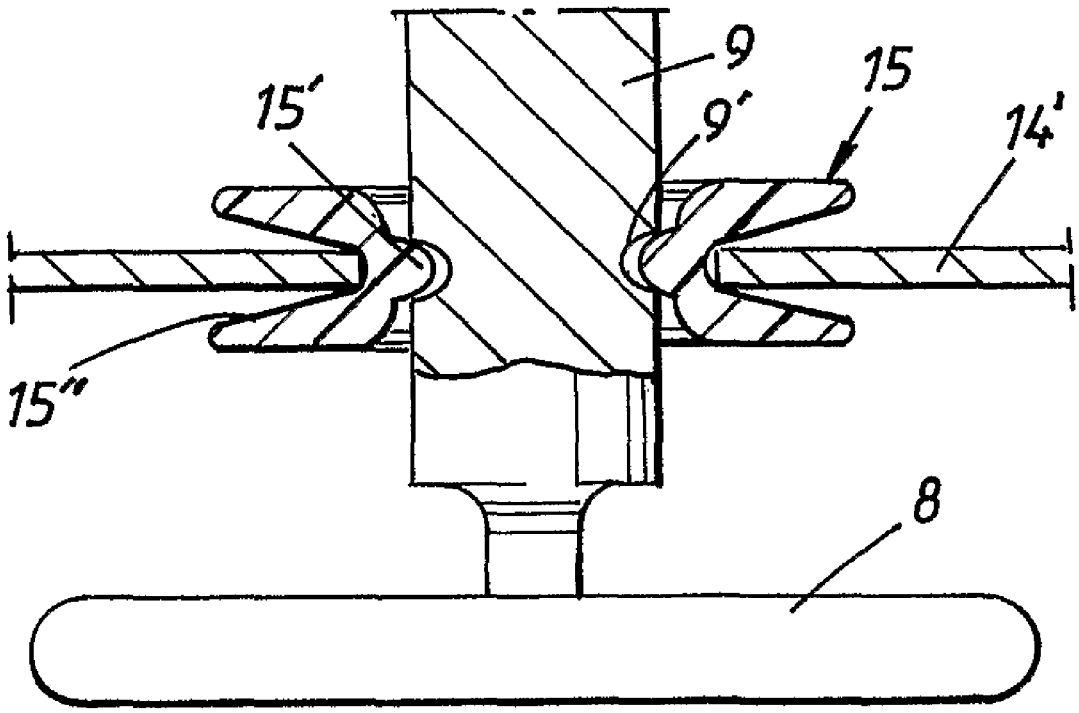
FIG. 3 illustrates the attachment/sealing means of the outer spring more in detail.

As illustrated in FIG. 2 the outer spring might be a thin membrane, plate or the like, made of a rubber or plastic material forming a part of the wall of the vibrator casing opposite to the bone anchored part of the hearing aid device. In contrast to a stiff metal plate the outer spring is in this case comparatively weak in all directions in order to improve the vibratory isolation, In FIG. 3 the attachment/sealing of the outer spring 14' is illustrated more in detail. The elastic element 15 is in this case made as a ring or collar having an inner portion 15' resting in a first recess 9' surrounding the vibratory transmitting element 9. The peripheral part of the elastic element is provided with a second recess 15" for the outer spring 14'. The outer spring and the elastic element might be designed as an integral part.

The invention is not limited to the examples that has been described above, but can be varied within the scope of the following claims.

The invention claimed is

1. A device for generating vibrations in a bone conducting hearing aid, comprising:

a vibrator, including:

a magnetic device;

a vibrator plate;

an inner spring member configured to provide an air-gap between the magnetic device and the vibrator plate; and a vibratory transmitting element;

a casing configured to house the vibrator;

an outer spring arranged between the vibratory transmitting element and the casing to isolate movements of the magnetic device relative to the casing, wherein the outer spring comprises a part of the surrounding casing; and an elastic sealing element mechanically attaching the outer spring to the vibratory transmitting element.

2. A device according to claim 1, wherein the outer spring is an integral part of the surrounding casing and has spring characteristics adapted to vibratory isolation.

3. A device according to claim 2, wherein the outer spring comprises a thin membrane or plate made of a rubber or plastic material and arranged on a part of the wall of the casing of the device which is opposite to the bone anchored part.

4. A device according to claim 1, wherein the elastic sealing element comprises a ring or collar, said ring or collar having an inner portion resting in a first recess surrounding the vibratory transmitting element and a peripheral part provided with a second recess for the outer spring.

5. The device of claim 1, wherein the casing is constructed and arranged to be operatively positioned externally on a recipient whereby an outside of the casing is exposed to an ambient environment external the recipient; and wherein the outer spring is configured to suspend the vibrator relative to the casing, and further configured to form part of the outside of the casing which is exposed to the ambient environment and to form at least part of a dust barrier between an inside of the casing and the ambient environment outside of the casing.

6. The device of claim 5, wherein:

the outer spring is integrated with the casing.

7. The device of claim 5, wherein:

the outer spring is part of the casing forms part of a sealing arrangement that seals an inside of the casing from dust entry from outside of the casing.

8. The device of claim 1, wherein:

the magnetic device and the vibrator plate move relative to one another upon activation of the vibrator to generate vibrations; and the vibrator plate is movably suspended relative to the magnetic device by the inner spring.

9. The device of claim 8, wherein:

the vibratory transmitting element is at least one of part of or mechanically connected to the vibrator plate; and the vibratory transmitting element extends from a first side of the outer spring facing an inside of the casing to a second side of the outer spring facing an outside of the device.

10. The device of claim 1, wherein:

the magnetic device includes at least one of a permanent magnet and a coil.

11. The device of claim 1, wherein the vibrator plate is rigidly mechanically attached to the vibratory transmitting element.

12. The device of claim 11, wherein:

the vibratory transmitting element includes a coupling apparatus, the coupling apparatus being configured to attach the device to a bone anchored part.

* * * * *